US011542729B2

(12) United States Patent
Couto Maquieira et al.

(10) Patent No.: US 11,542,729 B2
(45) Date of Patent: Jan. 3, 2023

(54) HANDLE SYSTEM WITH A SAFETY DEVICE

(71) Applicant: AKWEL VIGO SPAIN SL, Vigo Pontevedra (ES)

(72) Inventors: Delmiro Javier Couto Maquieira, Pontevedra (ES); Alberto Diez Estevez, Pontevedra (ES); Jose Oscar Vazquez Carballo, Vigo (ES)

(73) Assignee: AKWEL VIGO SPAIN SL, Vigo Pontevedra (ES)

( * ) Notice: Subject to any disclaimer, the term of this patent is extended or adjusted under 35 U.S.C. 154(b) by 103 days.

(21) Appl. No.: 16/843,319

(22) Filed: Apr. 8, 2020

(65) Prior Publication Data

US 2020/0318397 A1 Oct. 8, 2020

(30) Foreign Application Priority Data

Apr. 8, 2019 (FR) ..... 19/03734

(51) Int. Cl.
*E05B 77/04* (2014.01)
*E05B 79/16* (2014.01)
*E05B 85/10* (2014.01)

(52) U.S. Cl.
CPC ..... *E05B 77/04* (2013.01); *E05B 79/16* (2013.01); *E05B 85/10* (2013.01)

(58) Field of Classification Search
CPC ..... E05B 77/02; E05B 77/04; E05B 77/06; E05B 77/12; E05B 79/10; E05B 79/12; E05B 79/16; E05B 79/22; E05B 85/10; E05B 85/14; E05B 85/16; Y10T 292/57; Y10S 292/22; Y10S 292/65
See application file for complete search history.

(56) References Cited

U.S. PATENT DOCUMENTS 8,833,813 B2 * 9/2014 Muller ..... E05B 85/107 292/336.3
10,072,447 B2 * 9/2018 Fujiwara ..... E05B 81/90
(Continued)

FOREIGN PATENT DOCUMENTS

EP 1556569 B1 4/2009
EP 3396088 A1 * 10/2018 ..... E05B 85/103
(Continued)

*Primary Examiner* — Kristina R Fulton
*Assistant Examiner* — Noah Horowitz
(74) *Attorney, Agent, or Firm* — Oliff PLC

(57) ABSTRACT

The system includes a bracket, a handle pivotally mounted about a handle axis and including a main gripping branch and a secondary branch each extending on either side of the handle axis, a safety device configured to block an ejection of the handle towards its open position in the event of an impact. The device includes a blocking pawl elastically biased into a position of blocking the pivoting of the secondary branch according to a handle ejection direction and at least one lever for releasing the secondary branch in the ejection direction, the release lever being configured to drive the pawl, against its elastic biasing force, into a release position of the secondary branch, consecutively to a manual mechanical action of pushing in the handle from its flush position and/or to the triggering of an electric actuation for ejecting the handle from its flush position.

14 Claims, 6 Drawing Sheets

(56) References Cited

U.S. PATENT DOCUMENTS

| | | | | |
|---|---|---|---|---|
| 10,563,437 | B2 * | 2/2020 | Bartels | B60Q 1/2669 |
| 10,655,371 | B2 * | 5/2020 | Soonthornwinate | E05B 79/06 |
| 10,760,307 | B2 * | 9/2020 | Rocci | E05B 81/76 |
| 10,975,598 | B2 * | 4/2021 | Guerin | E05B 85/103 |
| 2018/0171686 | A1 | 6/2018 | Couto Maquieira et al. | |
| 2020/0190866 | A1 * | 6/2020 | Guerin | E05B 85/103 |
| 2020/0386019 | A1 * | 12/2020 | Jeong | E05B 81/06 |
| 2021/0156179 | A1 * | 5/2021 | Savant | E05B 17/0054 |

FOREIGN PATENT DOCUMENTS

| | | | | |
|---|---|---|---|---|
| FR | 3023865 | A1 * | 1/2016 | E05B 77/06 |
| FR | 3024173 | A1 | 1/2016 | |

* cited by examiner

HANDLE SYSTEM WITH A SAFETY DEVICE

TECHNICAL FIELD

The present invention concerns an opening control of a door leaf of a motor vehicle such as a door of a motor vehicle. More specifically but without restriction, the invention applies in particular to the field of safeguarding a motor vehicle by means of a safety device equipping a handle system of the opening control and configured to prevent the inadvertent opening of the door leaf during a violent impact caused for example by an accident.

STATE OF THE ART

In general, the closure of a door leaf, for example a door of the vehicle, is carried out by means of a latch comprising a pin secured to the door adapted to cooperate with a striker secured to the bodywork. In order to open the door leaf from outside the vehicle, a handle system known by the generic name of «external opening control» or also known by the acronym «EOC», is actuated.

Such a system comprises a handle which, when pulled by a user, causes the unlocking of the latch. In general, the handle of the door leaf of the motor vehicle is hingedly mounted on a support frame which is fixed with respect to the door leaf. For example, the system also comprises a pivoting transmission lever hinged in the support frame and which can be actuated by the handle. This pivoting lever is coupled to a transmission part such as a cable or a rail enabling the actuation of the latch.

The action exerted on the handle, translates, through the kinematic chain of the EOC, in the clearance of the pin off the striker and therefore the opening of the door. When the user releases the handle, the latter is brought back into the rest position by a biasing member.

In the absence of any safety device, it is understood that during a lateral impact, the inertial force related to the mass of the handle could reach, and even exceed, the tension force that is usually necessary to open the door. Indeed, a lateral impact is capable of generating high magnitude instantaneous accelerations on the handle. Hence, the magnitude of the generated inertial forces could be considerable, even with lightweight handles.

Besides, the stiffness of the spring of the handle is of course quite insufficient to resist the opening force exerted by the inertial force applied to the handle.

There are known various handle systems for vehicle door leaves, provided with a safety device allowing avoiding opening of the door leaf, in the event of an accident, by the effect of the deceleration undergone by the grip portion of the handle.

A first solution of a safety device proposed in the state of the art is based on an inertial principle and consists of a device with a counterweight and a biasing spring. The counterweight is mounted on an axis to which the handle is also connected, so as to impart on the axis, during a lateral impact, an inertial torque opposite to that of the inertial force yet without resisting the normal opening movement of the door because it consists in this case of slow movements with a low acceleration. When a user pulls on the handle to open the door, he drives at the same time the counterweight of the safety device, which is brought back afterwards into its initial position by the biasing spring when the user releases the handle.

This first solution has the advantage of being relatively inexpensive, but it has nonetheless drawbacks. In particular, the presence of a counterweight increases the bulk of the external opening control system across the thickness of the door and weighs down the vehicle with non-functional masses. Besides, this known safety device does not operate for very high accelerations because of the inertia of the counterweight.

A second solution of a safety device proposed in the state of the art is also an inertial solution, but operating this time by blocking the kinematic chain of the external opening control. This second known device is constituted by an inertial mass disposed so as to drive, during a lateral impact, a member adapted to block, for example, the transmission lever of the kinematic chain thereby preventing the clearance of the pin of the latch off the striker. A biasing spring is present to bring the inertial mass back into its rest position.

For example, such a solution is described in the European patent application EP 1 556 569 which discloses a «frigo handle» type handle, commonly known for its inertia at impacts, equipped with an inertial mass brought to be interposed on the pathway of a drive lever kinematically connected to a gripping portion of the handle, by the effect of such an impact.

There is also known the document US2018/171686 which describes an opening control of a door leaf of a motor vehicle, such as a door. Said control comprises a case intended to be fastened to the door leaf and a handle configured for gripping by a user, movable in rotation relative to the case between at least one flush position in which the handle is totally or partially housed within the case, an ejected position in which the handle comes at least partially out of the case, so that the user could grasp the handle and open the door leaf, and an open position, in which the handle has caused the unlocking of the door leaf. The opening control also comprises an ejection lever of the handle connected to the handle by at least one common axis of rotation. Moreover, the opening control comprises a safety device configured to block an ejection of the handle towards its open position in the event of an impact. This safety device comprises a blocking pawl which abuts against the internal lever and blocks the rotation of the handle in the clockwise direction, according to the direction of ejection of the handle and a second pawl. The latter consists of an ejection lever pawl subjected to an elastic biasing force with urges it into a position of engagement with the lever. This pawl, referred to as the ejection lever pawl, is provided with a first torsion spring. The function of the ejection lever pawl is to block the rotation of the ejection lever, and therefore to block the ejection of the handle. Indeed, the first pawl is arranged so as to be displaced between a first position in which the first pawl engages with the ejection lever and blocks the ejection of the ejection lever and a second position in which the first pawl is no longer engaged with the ejection lever.

Moreover, the document FR3024173 describes a handle assembly for opening a door leaf of a motor vehicle, for example a door. The handle assembly comprises at least: a case intended to be fastened to the door leaf, a lever configured for gripping by a user, the lever being movable in rotation relative to the case and at least between: a closed position, in which the lever is totally or partially housed within the case, an ejected position, in which at least one portion of the lever comes out from the case, so that the user could exert said gripping in order to cause an unlocking of the door leaf, and an open position, in which the lever has caused the unlocking of the door leaf. Furthermore, it comprises an ejection mechanism connected to the lever, the ejection mechanism comprising an ejection elastic member which is elastically deformable between: a considerably deformed position, in which the ejection elastic member exerts an ejection force adapted to displace the lever from the closed position to the ejected position, the considerably deformed position being reached when the lever is in the closed position, and a slightly deformed position, in which the ejection elastic member exerts a negligible force, the slightly deformed position being reached when the lever is in the ejected position, the ejection mechanism comprising a deformation device configured to deform the ejection elastic member when the lever is displaced from the ejected position to the open position.

All these inertial safety solutions have the drawback of operating only in one single direction. Consequently, in some cases of particular impacts, the safety device will be made ineffective. Furthermore, the balancing of the mass of the handle may result in a considerable bulk inside the opening control, an increase of the weight and therefore a non-negligible environmental impact.

DISCLOSURE OF THE INVENTION

The invention aims in particular at overcoming these drawbacks with a handle system which gets rid of the need to resort to inertial solutions while being particularly effective in the event of an impact, and that irrespective of the direction of the impact.

To this end, an object of the invention is a handle system for a door leaf of a motor vehicle comprising:

- a handle bracket,
- a handle pivotally mounted about a handle axis between at least one open position, a flush position and a pushed-in position, the handle comprising a main gripping branch and a secondary branch extending the main branch each extending on either side of the handle axis,
- a safety device configured to block an ejection of the handle towards its open position in the event of an impact, said handle system being remarkable in that the safety device comprises a blocking pawl elastically biased into a position of blocking the pivoting of the secondary branch according to a handle ejection direction and in that the safety device comprises at least one lever for releasing the secondary branch in the ejection direction, the release lever being configured to drive the blocking pawl, against its elastic biasing force, into a release position of the secondary branch, consecutively to a manual mechanical action of pushing in the handle from its flush position and/or to the triggering of an electric actuation for ejecting the handle from its flush position.

Thanks to the invention, during a violent impact, the handle remains blocked thanks to the blocking pawl which prevents the secondary branch from pivoting in the ejection direction of the handle. In order to actuate the handle system, the latter comprises at least one release lever which allows disengaging the blocking pawl and therefore releasing the secondary branch in the ejection direction of the handle.

A handle system according to the invention may include one or more of the following features listed hereinafter.

In a preferred embodiment, the safety device comprises first and second levers configured to release the blocking pawl respectively in reaction to the manual mechanical action and in response to the electric triggering.

In another embodiment of the invention, the blocking pawl has an elongated general shape, in particular a finger-like shape, which extends longitudinally in a vertical direction and is provided at an upper end with a blocking means which cooperates with a complementary means arranged on the secondary branch.

In another embodiment of the invention, the safety device comprises a shaft mounted on the bracket about which the pawl is pivotally movable and a member for elastically biasing the blocking pawl into the blocking position.

In another embodiment of the invention, said at least one release lever comprises a catch tiltably mounted in the bracket configured to cooperate with the blocking pawl such that the tilting of the catch drives the blocking pawl into its release position.

In another embodiment of the invention, the catch is provided with a retaining sear cooperating with a complementary bearing formed on the secondary branch, the sear and the bearing being configured so that the push-in of the handle into its pushed-in position causes the tilting of the catch.

In another embodiment of the invention, the blocking pawl comprises a transverse extension stud and the catch is provided with a recess within which the stud is housed in the blocking position, the recess flaring outwardly while delimiting a step so as to form a fork configured to retain and drive the stud during the tilting of the catch.

In another embodiment of the invention, the catch has a cam profile delimiting a guide surface so as to cooperate with the secondary branch and shaped so as to reposition the catch after the tilting thereof.

In another embodiment of the invention, the secondary branch is free to pivot in the direction opposite to the direction of ejection of the handle.

In another embodiment of the invention, the push-in mechanical action of the handle triggers a mechanical ejection of the handle.

In another embodiment of the invention, said release lever comprises a member movably mounted so as to pivot on a pivot axis common with the blocking pawl and elastically pre-biased in the blocking position of the pawl such that the triggering of an electric actuation releases the member in pivoting in a direction opposite to its pre-biasing driving with it in pivoting the blocking pawl out of its blocking position.

In another embodiment of the invention, the safety device is configured so that the moment applied with respect to the common pivot axis of the elastic biasing force exerted on the pre-biased member is higher than the moment of the elastic biasing force exerted on the blocking pawl.

In another embodiment of the invention, the handle system comprises an electric actuator and an electric ejection lever arm of the handle controlled by the actuator to be displaced between an initial pre-biasing position of the pivoting member in which the handle is in a flush position and an end ejection position of the handle.

In another embodiment of the invention, said member is elastically pre-biased by the ejection arm into the blocking position, the electric actuation of the arm progressively releasing the elastic tensioning of the member.

BRIEF DESCRIPTION OF THE DRAWINGS

Other features and advantages of the invention will appear in light of the following description, made with reference to the appended drawings in which.

EMBODIMENT OF THE INVENTION

Figure 1:
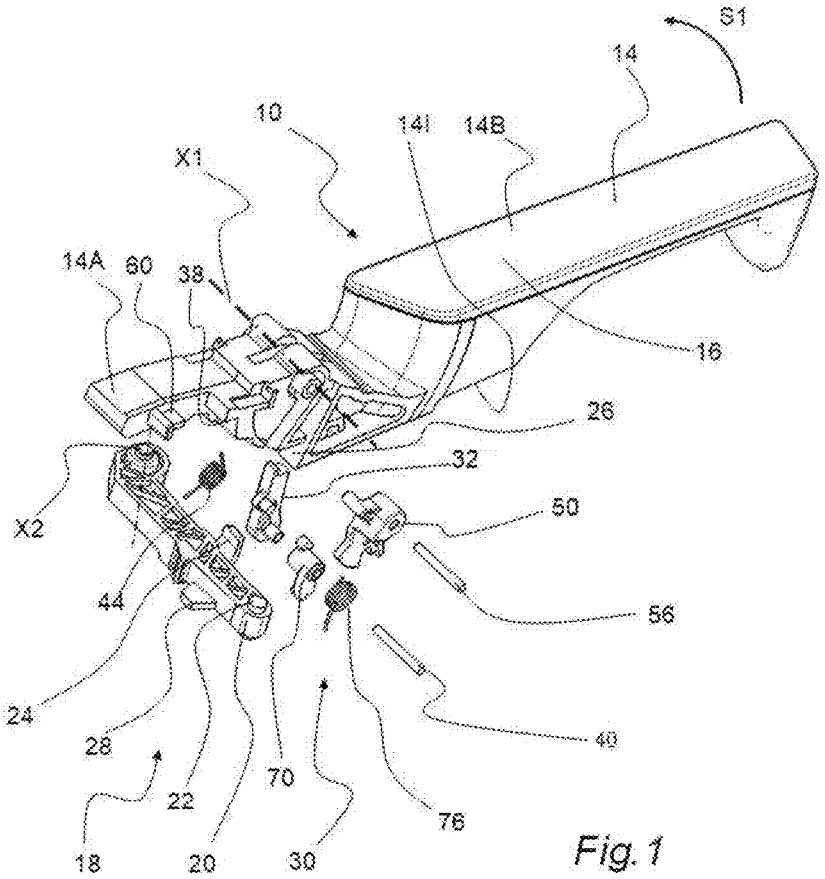
FIG. 1 represents an exploded schematic perspective view of a handle system according to the invention.

In FIG. 1, there is represented a handle system according to the invention for a door leaf of a motor vehicle.

This handle system is referred to by the general reference numeral 10.

Figure 2:
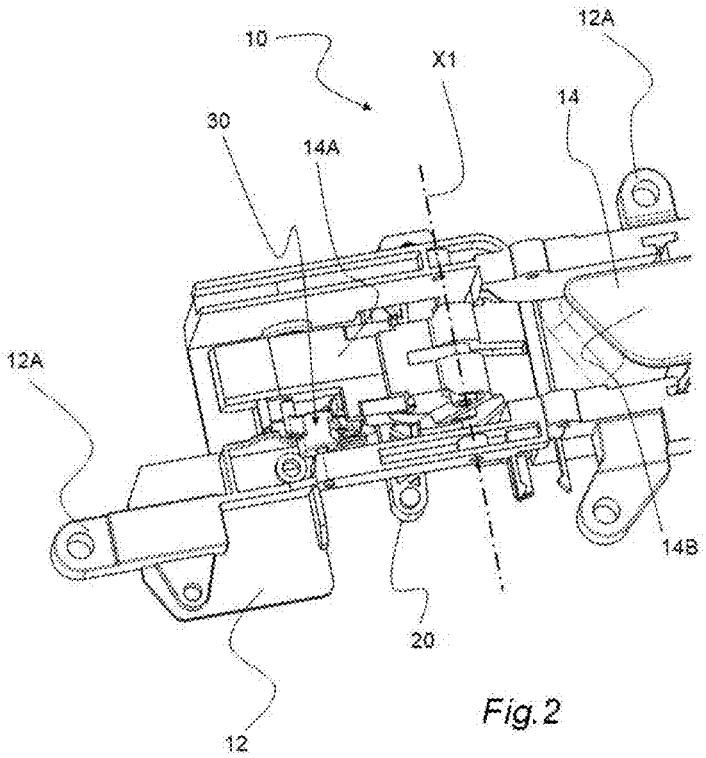
FIG. 2 represents a partial perspective top view of the handle system of FIG. 1 in the mounted state.

In this example, the handle system 10 includes a handle support frame or bracket 12 represented in FIG. 2 and a handle 14 configured to be pivotally mounted in this bracket 12 about a first pivot axis X1, hereinafter referred to as the handle axis. In operation, the bracket 12 is intended to be fastened to the door leaf for example by fastening legs 12A shown in FIG. 2. In the described example, the handle 14 is hingedly mounted relative to the panel, about a geometric pivot axis X1, on the bracket 12. In the operating position, the pivot axis X1 is substantially vertical and extends parallel to the general plane of the external panel.

The handle 14 is illustrated in detail in FIG. 1. According to the invention, the handle 14 has a main gripping branch forming an outer portion 14B that the user can grasp and opposite to the outer portion 14B, the handle 14 has a secondary branch forming an inner portion 14A which is intended to extend inside the housing of the bracket 12. Conventionally and without limitation, on the outer portion 14B, the handle 14 includes a gripping pad 16, which generally has a flat and elongated shape.

In the described example, the handle 14 is of the «flush» type, that is to say the cavity of the bracket 12 is dimensioned so as to receive the handle 14 in a retracted configuration. In this retracted configuration, the external surface of the handle 14 is flush with the external surface of the external wall of the door leaf. In the extended or deployed configuration, the handle 14 comes out at least partially from the cavity of the bracket 12 so as to enable grasping thereof by a user of the vehicle in order to open the door. For this purpose, the user can pull the handle 14 further outwards in order to control the latch of the door and the opening of the door leaf. In the flush position, the external surface of the opening control 10 coincides with the external surface of the door leaf. This «flush» arrangement, known in the automotive industry, allows enhancing the style of the vehicle and reduces the aerodynamic drag.

In this example, the handle system 10 is intended to cooperate with a latch (not represented) of the door leaf of the motor vehicle prone to adopt a locked configuration and an unlocked configuration. Conventionally, the pivoting of the handle 14 about its hinge axis X1 actuates the latch in either one of the locked or unlocked configurations via a drive kinematic chain (not represented in the figures).

In the example illustrated in FIG. 1, the handle system 10 comprises an electric actuation portion 18 enabling an electric actuation of the ejection and/or of the retraction of the handle 14.

The electric actuation portion 18 will now be described in detail. For its electric operation, as illustrated in FIG. 1, the electric actuation portion 18 comprises in this example an electric actuator (not represented) connected to an electric ejection lever arm 20 intended to extend longitudinally according to a transverse direction and pivotally. For example, the electric actuator comprises a linear cylinder provided with an end adapted to cooperate with an end of the ejection lever arm 20 so as to make the lever arm 20 pivot about a vertical axis X2. For example, the ejection lever arm 20 comprises a projecting pin 22 cooperating for example with a complementary notch (not represented) formed on the end of the cylinder.

The ejection arm 20 is also provided with a tab 24 extending vertically. Furthermore, preferably, as shown in FIG. 1, the lower face 14I of the handle 14 comprises a shoulder delimiting a substantially transverse bearing wall 26 from which the secondary inner branch 14A extends axially and against which bears the ejection lever arm 20 so as to enable the pivoting of the handle 14 by electric actuation. For example, the tab 24 is intended to press on the bearing wall 26. The ejection arm 20 also has a lug 28 which projects axially.

It is known that it is desirable to electrically control the ejection of the handle 14 of the door leaves of the motor vehicle. But, for the case where there would be a breakdown of the electric power supply, the handle 14 should of course enable manual maneuvering thereof, for example by simply acting on the handle 14 itself.

Thus, in the described example, the handle system 10 also comprises a backup mechanical portion enabling a manual mechanical actuation of the ejection and retraction movement of the handle 14 in the event of a failure of the electric actuator. For example, in the event where the electric operation turns out to be impossible because of an electric failure, the backup mechanism is provided for example with an elastic energy accumulator. In an advantageous but non-limiting embodiment, the push-in of the handle 14 allows triggering the backup mechanism.

For example, the backup mechanism is configured to be mechanically activated in response to a push-in action of the handle 14, the end of the push-inaction or the release being adapted to cause the triggering of the backup mechanism. For example, the backup mechanism comprises a kinematic drive chain for moving the handle 14 which automatically drives the movement of the handle 14 over all or part of a stroke starting from the pushed-in position of the handle 14 to the flush position through the ejected position. Preferably, the mechanism is configured to drive the movement of the handle 14 over the entire stroke. Of course, other embodiments of the backup mechanical operation may be suitable yet without departing from the scope of the invention.

In accordance with the invention, the handle system 10 comprises a safety device 30. This safety device 30 is configured to block an ejection of the handle 14 towards its open position in the event of an impact.

In the following description, the terms "upper" and "lower" as well as the other equivalent expressions that are used should be understood by taking as a reference in the appended drawings, an axis with a vertical direction, which corresponds to a use of the handle system resting on a horizontal plane. Hence, these orientations are used only with reference to the description hereinafter and to the figures and do not correspond to the actual orientations of the elements in an operational use of the handle system, that is to say integrated to a door leaf of the motor vehicle. The same applies to the counterclockwise S1 and clockwise S2 directions of rotation which relate to the appended figures.

The safety device 30 comprises a blocking pawl 32. As represented in detail in FIG. 6, the blocking pawl 32 has an elongated general shape, for example a finger-like shape. This pawl 32 extends longitudinally, in the mounted state and in a blocking configuration illustrated in FIG. 7, according to a substantially vertical direction. In the described example, the pawl 32 has an upper free end 34 forming a blocking end cooperating with the secondary branch 14A. For example, the upper end 34 comprises a blocking means 36 cooperating with a complementary means 38 formed on the secondary branch 14A. For example, these complementary means 36, 38 are of the interlocking type with complementary interlocking profiles formed on the blocking surfaces in mutual contact.

This pawl 32 is pivotally mounted about a pivot axis extending transversely. To this end, the safety device 30 comprises a pivot rod 40 mounted on the bracket 12 about which the pawl 32 is pivotally mounted. For example, the pawl 32 is provided on one of its faces with a hollow sleeve 42 delimiting a cylindrical bore for receiving the pivot rod 40.

Figure 5:
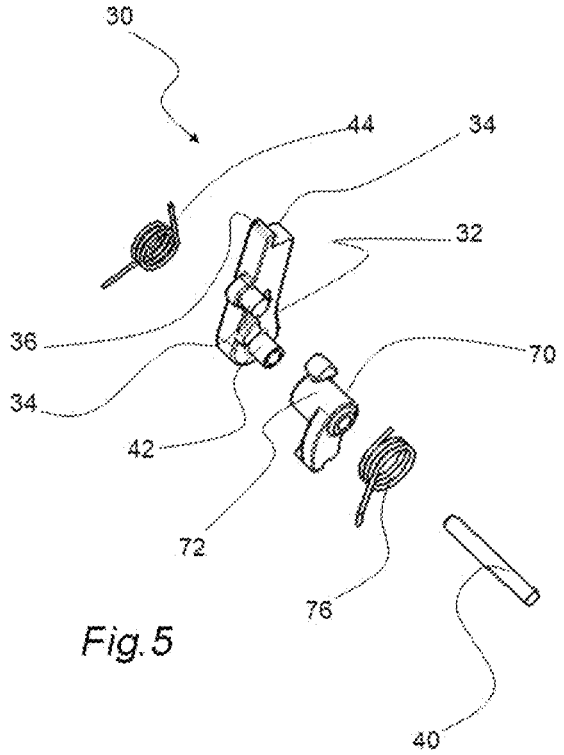
FIG. 5 represents a perspective detail view in the dismounted state of a mounting pawl and of a release lever of the handle system of FIG. 1.
Figure 6:
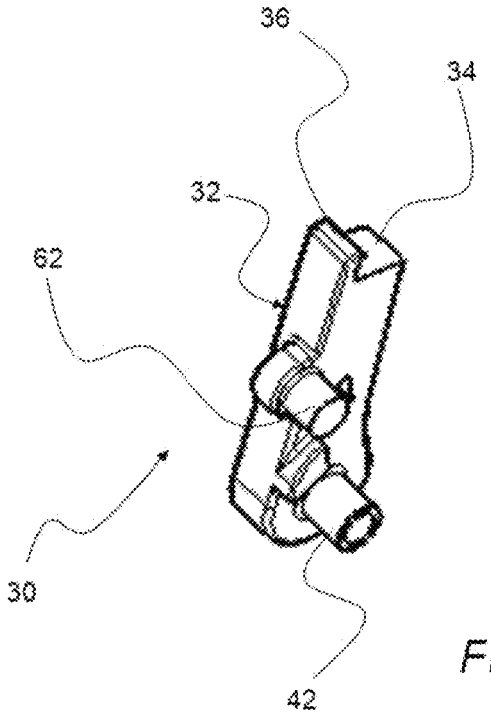
FIG. 6 represents a detail schematic view of the blocking pawl of FIG. 5.

Referring to FIGS. 5 and 6, the blocking pawl 32 is configured to be elastically biased into a position of blocking the pivoting of the secondary branch 14A in a (counterclockwise) ejection direction S1 of the handle. In the described example, the safety device 30 comprises an elastic biasing member 44 of the pawl 32 configured to exert a biasing force into the blocking position. As illustrated in FIG. 5, the elastic biasing member 44 comprises a torsion helical spring. For example, this elastic member 44 is connected on the one hand to the blocking pawl 32 and on the other hand to the bracket 12.

Furthermore, the safety device 30 comprises at least one lever for releasing the secondary branch 14A in pivoting in the ejection direction S1 of the handle. In accordance with the invention, the release lever is configured to drive the blocking pawl 32 in a release direction of the secondary branch 14B, against the elastic biasing force of the blocking pawl 32 into the blocking position. The driving of the pawl 32 into this release position is carried out either in reaction to a manual action of pushing in the handle 14 from its flush position, or in reaction to the triggering of an electric action of ejecting the handle 14 from its flush position.

Preferably, the system 10 comprises two release levers: a first release lever 50 enables the disengagement of the blocking pawl 32 in response to the manual action and a second release lever 70 enables the disengagement of the blocking pawl 32 in response to the electric action.

The two release levers 50 and 70 of the blocking pawl 32 will now be described in more detail hereinafter.

Figure 3:
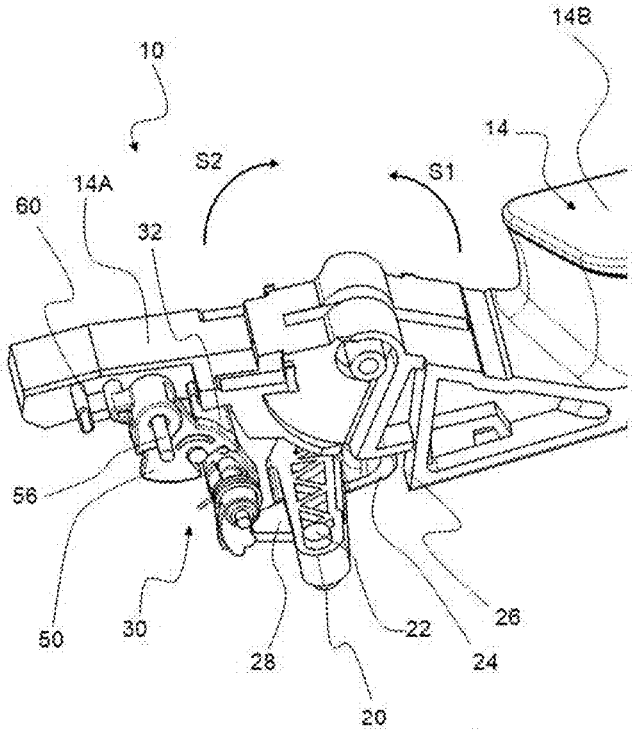
FIG. 3 represents a side partial perspective view of the handle system of FIG. 1.

Preferably and as illustrated in FIG. 3, the first lever 50 comprises a catch tiltably mounted in the bracket 12 configured to cooperate with the blocking pawl 32. The catch 50 is configured to cooperate with the secondary branch 14B such that a tilting of the catch 50 in a clockwise direction S2 drives the blocking pawl 32 into its release position. Furthermore, in the described example, the secondary branch 14A is free to pivot in the direction S2 opposite to the ejection direction S1. Indeed, in the described example, the blocking pawl 32 blocks the pivoting of the secondary branch 14A only in the ejection direction S1.

Figure 4:
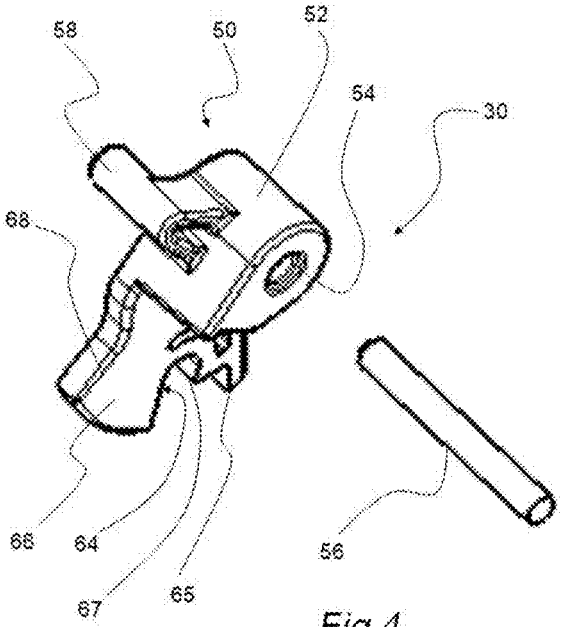
FIG. 4 represents a perspective detail view of a catch of the blocking pawl of the handle system of FIG. 1.

Such a catch 50 is illustrated in detail in FIG. 4. The catch 50 comprises a body provided with an upper head 52 provided with a cylindrical bore 54 for receiving a pivot rod 56. In this example, the rod 56 is fixedly mounted relative to the handle bracket 12 and the catch 50 is tiltably mounted about this rod 56.

Preferably, the catch 50 is provided with a retaining sear 58 cooperating with a complementary bearing 60 formed on the secondary branch 14A. In the illustrated example, the retaining sear 58 extends according to an axial direction from the head 52.

As shown in FIG. 3, the sear 58 and the bearing 60 are configured so that the push-in of the handle 14 towards its pushed-in position causes the tilting of the catch 50 in a clockwise direction S2. Preferably, the bearing 60 is formed on a lateral face of the secondary branch 14A by forming an «L»-like shaped projecting relief, the retaining sear 58 resting on a branch of the «L» which extends axially.

Furthermore, preferably, the blocking pawl 32 comprises a transverse extension stud 62 and the catch 50 is provided with a recess 64 within which the stud 62 is housed in the blocking position. In the example, the body of the catch 50 thus comprises a lower portion 66 configured for the gripping of the blocking pawl 32. Thus, as illustrated, the catch 50 has a lower extension 66 of the head 55 shaped like a plate into which the recess 64 is formed.

In the described example, the recess 64 comprises an internal notch with a rounded bottom which extends outwardly in a flared portion by forming a fork 65 configured to drive and retain the stud 62 during the tilting of the catch 50 in the clockwise direction S2. In this example, the recess 64 is provided with a step 67 delimiting on the one hand the internal notch and on the other hand the outer flared portion shaped like a fork 65.

Moreover, the catch 50 has a cam profile delimiting a guide surface 68 for cooperating with the secondary branch 14A and enabling the repositioning of the catch 50 after the tilting thereof. In the described example, the guide surface 68 is shaped so as to cooperate with the projecting relief forming the bearing 60 of the secondary branch 14A. For example, this guide surface 68 comprises a curved profile.

Preferably and as illustrated in FIG. 5, the second lever 70 comprises a pivoting member about a pivot axis common with the blocking pawl 32. In the described example, the pivoting member 70 comprises a cylindrical sleeve 72 configured to be concentrically mounted around the cylindrical sleeve 42. Preferably, the pivoting member 70 further comprises a stop 74, shown in FIG. 7, preferably delimiting a curvilinear external profile adapted to cooperate with the ejection arm 20, for example with the axial lug 28.

Referring to FIG. 5, the pivoting member 70 is configured to be elastically biased into a release position of the blocking pawl 32. In the described example, the safety device 30 comprises an elastic biasing member 76 of the pivoting member 70 configured to exert a biasing force on the pivoting member 70 so as to drive the blocking pawl 32 out of its blocking position. As illustrated in FIG. 5, the elastic biasing member 76 comprises a torsion helical spring. For example, this elastic member 76 is connected on the one hand to the pivoting member 70 and on the other hand to the support 12.

Preferably, in the blocking position of the pawl 32, the pivoting member 70 is elastically pre-tensioned or pre-biased by the ejection arm 20. The displacement of the arm 20 during the electric actuation of the ejection of the handle 14 enables the progressive release of the tensioning of the member 70 which is elastically biased, in a direction opposite to the pre-biasing thereof, towards a rest position and which drives, in its movement, the blocking pawl 32 out of its blocking position.

Preferably, the safety device 30 is configured so that the moment applied with respect to the common pivot axis of the pawl 32 and of the member 70 of the elastic biasing force exerted on the pre-tensioned member 70 is higher than the moment of the elastic biasing force exerted on the blocking pawl 32.

The main operation aspects of a handle system according to the invention will now be described in two operating configurations: an electric configuration illustrated by FIGS. 7 to 9 and a mechanical configuration illustrated by FIGS. 7 and 10 to 12.

Figure 7:
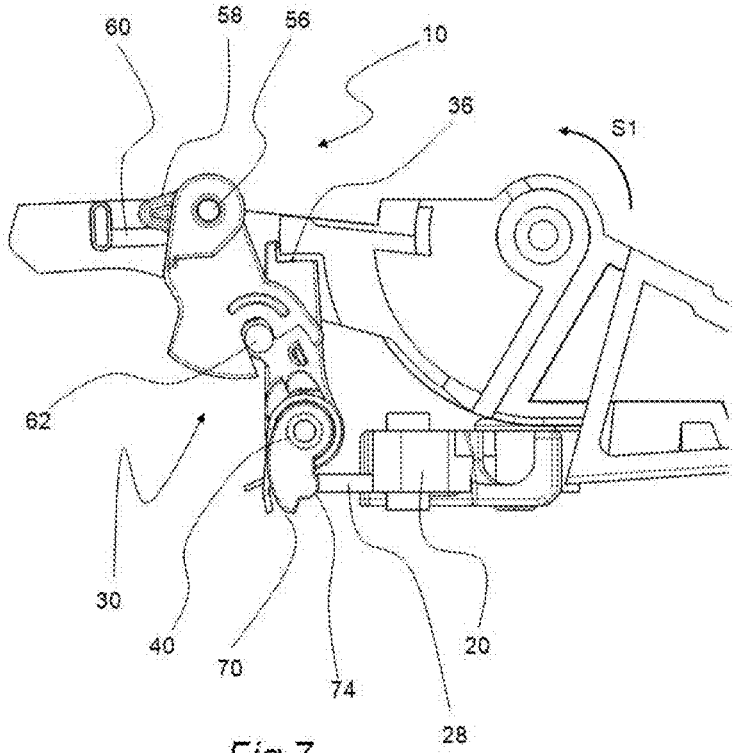
FIG. 7 represents a perspective side view of the handle system in a blocking configuration.

In the initial state common to both operating configurations, the system is like in FIG. 7. In this initial state, the blocking pawl 32 prevents the secondary branch 14A from performing a rotation in the counterclockwise direction S1 and therefore prevents the ejection of the handle 14 in the direction S1 schematized by the corresponding arrow. The stud 62 of the blocking pawl 32 is in place inside the recess 64 of the catch 50 and the pivoting member 70 is pre-tensioned by the initial position of the electric ejection arm 20. In this configuration, in the event of a violent impact, the pivoting of the secondary branch 14A is blocked by the blocking pawl 32 which prevents the ejection of the handle 14 and therefore the inadvertent opening of the door leaf.

Figure 8:
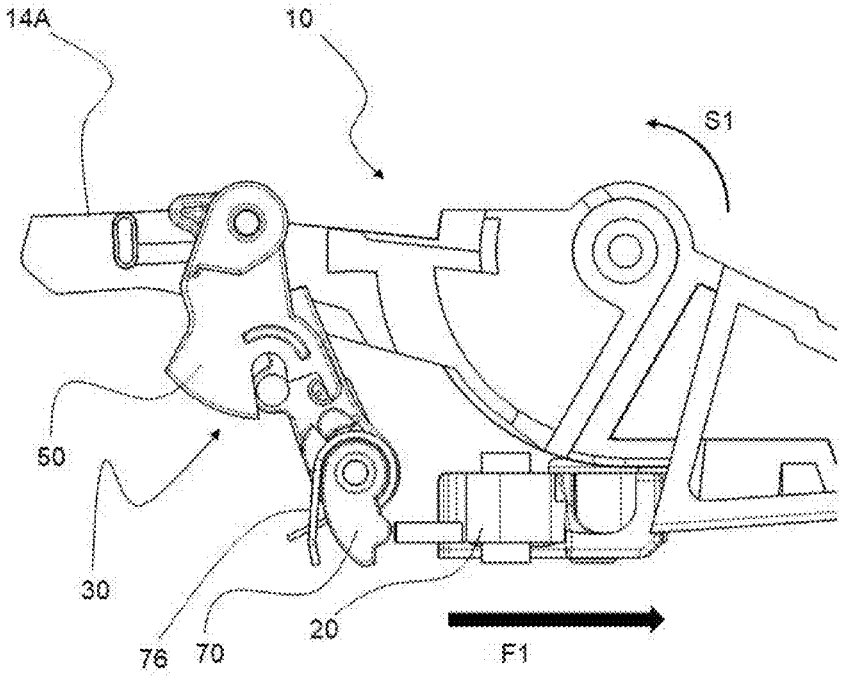
FIG. 8 represents the handle system of FIG. 7 in a release configuration of the blocking pawl by electric actuation of the handle during a first step.
Figure 9:
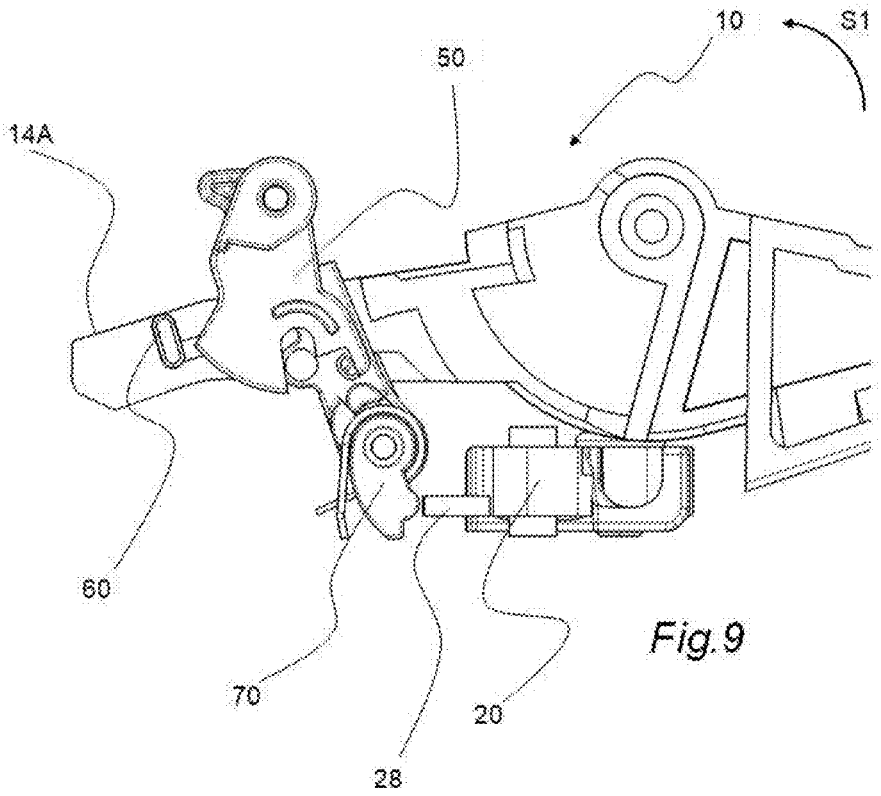
FIG. 9 represents the handle system of FIG. 8 during a second step.

In FIG. 8, the electric control for ejecting the handle 14 causes the displacement of the ejection arm 20 in the direction of the arrow F1 and the progressive release of the tensioning on the pivoting member 70 which starts moving. The pivoting of the pivoting member 70 causes the pivoting of the blocking pawl 32 in the counterclockwise direction S1. The handle 14 is then ejected as illustrated in FIG. 9.

In contrast with the electric control for retracting the handle 14 causes the displacement of the ejection arm 20 in a direction opposite to the direction of the arrow F1 and positions the pivoting member 70 in a pre-tensioned state also bringing the blocking pawl 32 simultaneously back into its blocking position.

Figure 10:
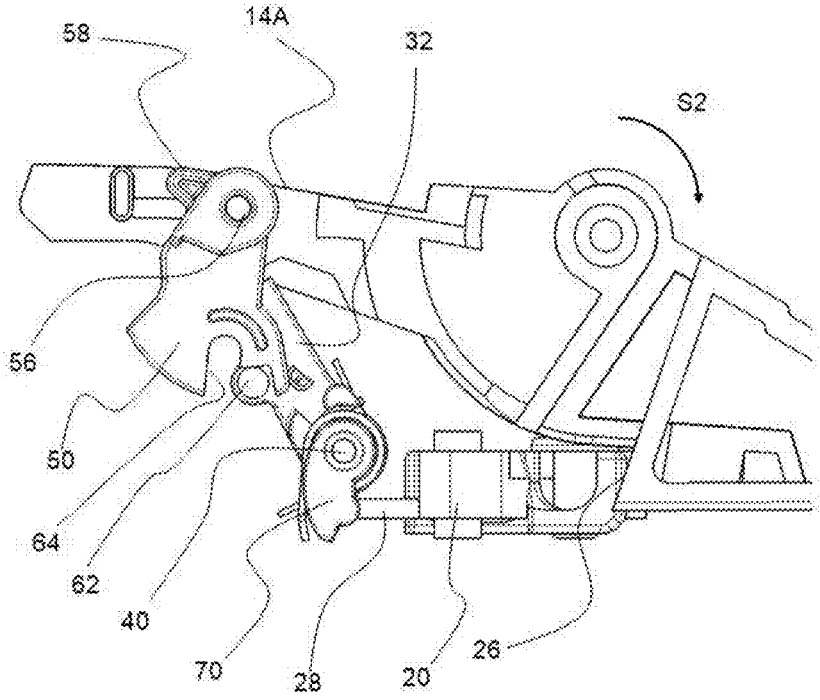
FIG. 10 represents the system of FIG. 7 in a configuration of the blocking pawl by manual mechanical actuation of the handle during a first step of pushing in the handle.

In FIG. 10, a manual action of pushing in the handle 14 results in making the catch 50 tilt in the clockwise direction S2. Indeed, the pivoting of the secondary branch 14A in the clockwise direction S2 causes the pivoting of the bearing 60 which drives the sear 58 of the catch 50 and causes the tilting of the latter. The stud 62, which was initially housed at the bottom of the recess 64 is guided along the step 67 up to the flared portion of the recess 64 shaped like a fork 65. Hence, the continuation of the tilting of the catch 50 causes the pivoting of the blocking pawl 32 in the direction S1 and the release of the secondary branch 14A. The handle 14 is then mechanically ejected until reaching its open position illustrated in FIG. 11.

Figure 11:
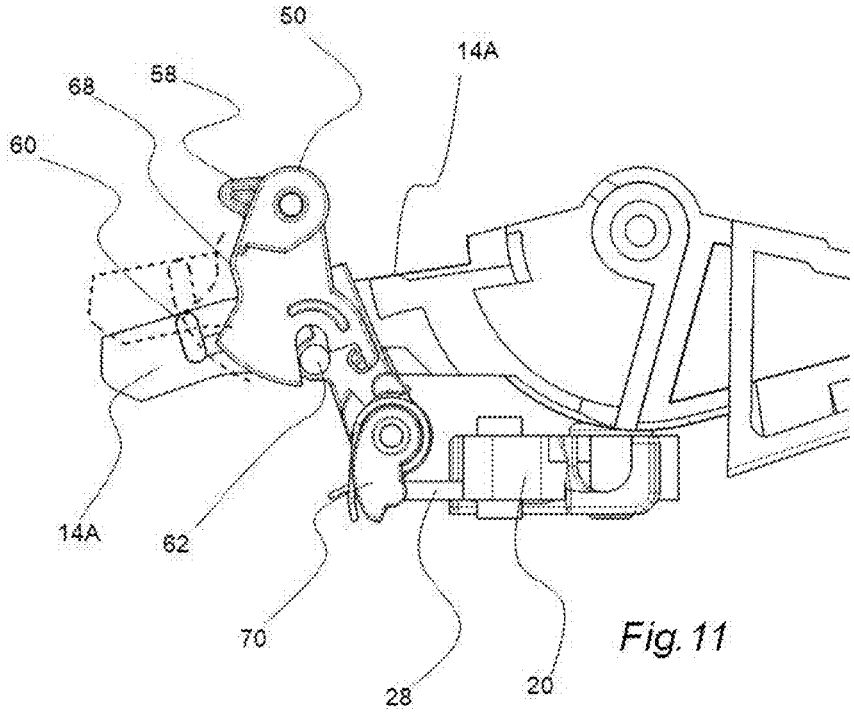
FIG. 11 represents the system of FIG. 10 during a second step of ejecting the handle.
Figure 12:
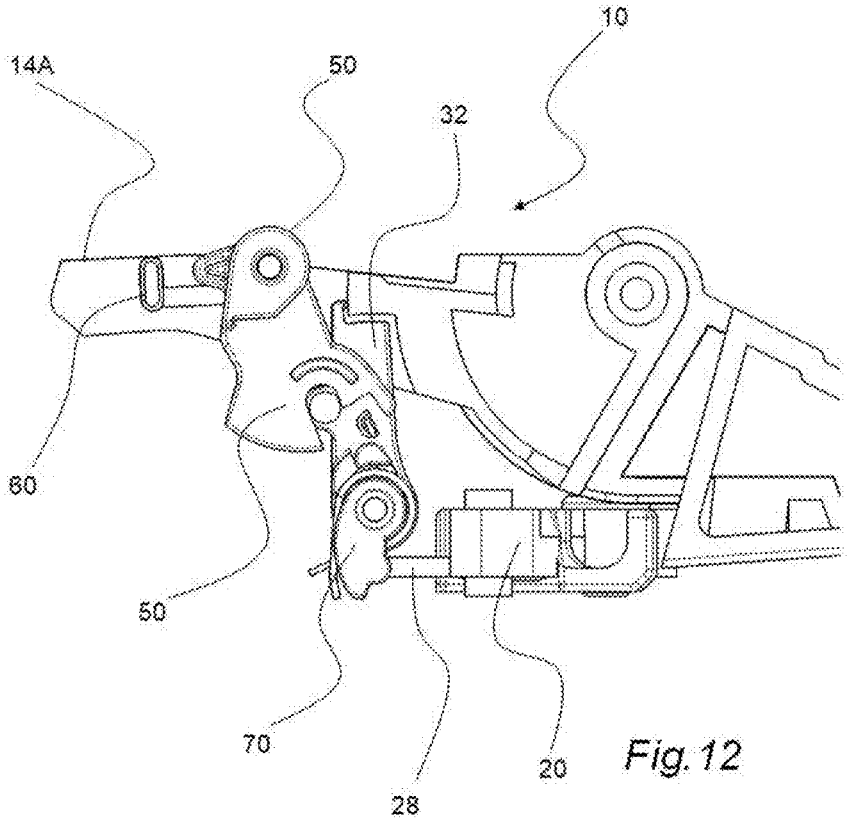
FIG. 12 represents the system of FIG. 11 after return back to its initial state of blocking the handle.

In the example illustrated in FIG. 11, during the return of the handle 14 from the open position back into the flush position, the catch 50 is repositioned thanks to tits guide profile 68 and the complementary bearing 60 of the secondary branch 14A.

Thus, thanks to the invention, during a violent impact and irrespective of the direction of the impact with respect to the handle system 10, the handle 14 is held in its closed position. Furthermore, the handle system 10 enables the normal operation in the manual mode and/or in the electric mode of the actuation of the handle 14.

Of course, the invention is not limited to the previously described embodiments. Other embodiments within the reach of those skilled in the art may also be considered yet without departing from the scope of the invention defined by the claims hereinafter.

The invention claimed is:

1. A handle system for a door leaf of a motor vehicle, a handle system comprising:

a handle bracket, a handle pivotally mounted relative to the handle bracket, the handle being configured to pivot about a handle axis between at least an open position, a flush position and a pushed-in position, the handle including a main gripping branch and a secondary branch extending from the main gripping branch, which each extend from an opposite side of the handle axis, a safety device configured to block an ejection of the handle towards the open position in the event of an impact, the safety device including:

a blocking pawl elastically biased into a blocking position of blocking a pivoting of the secondary branch in a handle ejection direction, and at least one release lever configured to release the secondary branch in the ejection direction, the release lever being configured to drive the blocking pawl, against an elastic biasing force, into a release position to release the secondary branch, after a manual mechanical action of pushing in the handle from the flush position or after a triggering of an electric actuation to eject the handle from the flush position.

2. The system according to claim 1, wherein the safety device further includes a first lever and a second lever configured to release the blocking pawl respectively in reaction to the manual mechanical action and in response to the triggering of the electric actuation.

3. The system according to claim 1, wherein the blocking pawl has an elongated shape, the blocking pawl extending longitudinally in a vertical direction relative to the motor vehicle, and the blocking pawl includes, at an upper end of the blocking pawl, a blocking means which cooperates with a complementary means arranged on the secondary branch.

4. The system according to claim 1, wherein the safety device further includes:

a shaft mounted on the handle bracket, the blocking pawl being pivotally movable about the shaft, and a member for elastically biasing the blocking pawl into the blocking position.

5. The system according to claim 1, wherein the at least one release lever includes a catch tiltably mounted to the handle bracket, the catch being configured to cooperate with the blocking pawl such that a tilting of the catch drives the blocking pawl into the release position.

6. The system according to claim 5, wherein the catch includes a retaining sear cooperating with a complementary bearing formed on the secondary branch, the sear and the bearing being configured so that the manual mechanical action of pushing in the handle into the pushed-in position causes the tilting of the catch.

7. The system according to claim 5, wherein the blocking pawl includes a transverse extension stud and the catch includes a recess, the transverse extension stud being housed in the recess in the blocking position, and the recess flaring outwardly while delimiting a step to form a fork configured to retain and drive the transverse extension stud during the tilting of the catch.

8. The system according to claim 5, wherein the catch has a cam profile delimiting a guide surface to cooperate with the secondary branch and the catch is shaped to reposition the catch after the tilting of the catch.

9. The system according to claim 1, wherein the secondary branch is configured to be free to pivot in a direction opposite to the handle ejection direction.

10. The system according to claim 1, wherein the manual mechanical action of pushing in the handle is configured to trigger a mechanical ejection of the handle.

11. The system according to claim 1, wherein the at least one release lever includes a pivoting member movably mounted to be configured to pivot on a pivot axis common with the blocking pawl and the pivoting member is elastically pre-biased in the blocking position of the blocking pawl such that the triggering of the electric actuation releases the pivoting member to pivot in a direction opposite to the elastic pre-biasing to pivot the blocking pawl out of the blocking position.

12. The system according to claim 11, wherein the safety device is configured such that a moment applied about the common pivot axis of the elastic biasing force exerted on the pivoting member is higher than a moment about the common pivot axis of the elastic biasing force exerted on the blocking pawl.

13. The system according to claim 11, further comprising an electric actuator and an electric ejection lever arm of the handle, the electric ejection lever arm controlled by the electric actuator to be displaced between an initial pre-biasing position of the pivoting member in which the handle is in the flush position and an end ejection position of the handle.

14. The system according to claim 13, wherein the pivoting member is configured to be elastically pre-biased by the ejection lever arm into the blocking position, and the electric actuation of the ejection lever arm is configured to progressively release the elastic tensioning of the pivoting member.

* * * * *